US005215240A

United States Patent [19]

Berg et al.

[11] Patent Number: 5,215,240

[45] Date of Patent: Jun. 1, 1993

[54] ADHESIVE TAPE DISPENSER

[75] Inventors: Jack V. Berg; Randall G. Koza, both of Maplewood, Minn.

[73] Assignee: Minnesota Mining and Manufacturing Company, St. Paul, Minn.

[21] Appl. No.: 851,047

[22] Filed: Mar. 13, 1992

[51] Int. Cl.[5] ..... B26F 3/02

[52] U.S. Cl. ..... 225/16; 225/24

[58] Field of Search ..... 225/16, 24, 21, 22, 225/23; 83/28

[56] References Cited

U.S. PATENT DOCUMENTS

| | | | |
|---|---|---|---|
| 2,710,063 | 6/1955 | Krueger | 225/16 |
| 2,760,572 | 8/1956 | Krueger | 225/21 |
| 2,849,065 | 8/1958 | Krueger et al. | 225/24 X |
| 3,527,385 | 9/1970 | Komura | 225/24 |

OTHER PUBLICATIONS

M-920 Model 273, 3M Brochure #34-7004-71-41-9A(89.3)R1.
M-811 & M-812, 3M Brochure #P-IBDL(12.5)R.
M-851, 3M Brochure #34-7004-7089-OC(41.15)R1.
Tips from TCE, 3M Brochure #P-ITC9(87.1)R2.
M-920, Model 49000, 3M Brochure #34-7004-7478-5-(A90.15)R.
M-96, Model 38300, 3M Brochure #34-7004-73-41-5(F42.26)R1.
M-82, Model 58800, 3M Brochure #34-7004-7423-1-(A58.15)R1.

*Primary Examiner*—Douglas D. Watts
*Assistant Examiner*—Kenneth E. Peterson
*Attorney, Agent, or Firm*—St. Paul, MN 55133-3427; Gary L. Griswold; Walter N. Kirn

[57] ABSTRACT

A definite length dispensing apparatus for dispensing thin adhesive tape includes a rotatable feed mechanism, a drive assembly and a rotatable stripper mechanism. The feed mechanism includes a plurality of spaced feed discs that are configured to remove a continuous strip of adhesive tape from the supply of adhesive tape. The drive assembly includes a manually operated lever arm which is coupled to the feed mechanism through a gear assembly. The drive assembly drives the feed mechanism. The stripper mechanism is positioned adjacent to the feed mechanism. The stripper mechanism includes a plurality of spaced stripper discs, with each stripper disc having a peripheral edge defined by alternating curved and straight edge sections. Adjoining stripper discs are rotated relative to one another such that a curved section of one stripper disc is adjacent to the straight section of an adjacent stripper disc. There are multiple feed discs for every one stripper disc.

16 Claims, 7 Drawing Sheets

10
57
THIN TAPE
42b
20
52
14
46
44
12
54
138
42a
140
42a
THICK TAPE
112
120
96
82
70
68
42b
110
118
100
86
40
102
94
98

52
14
56
44
48
46
114
110
112
12
122
118

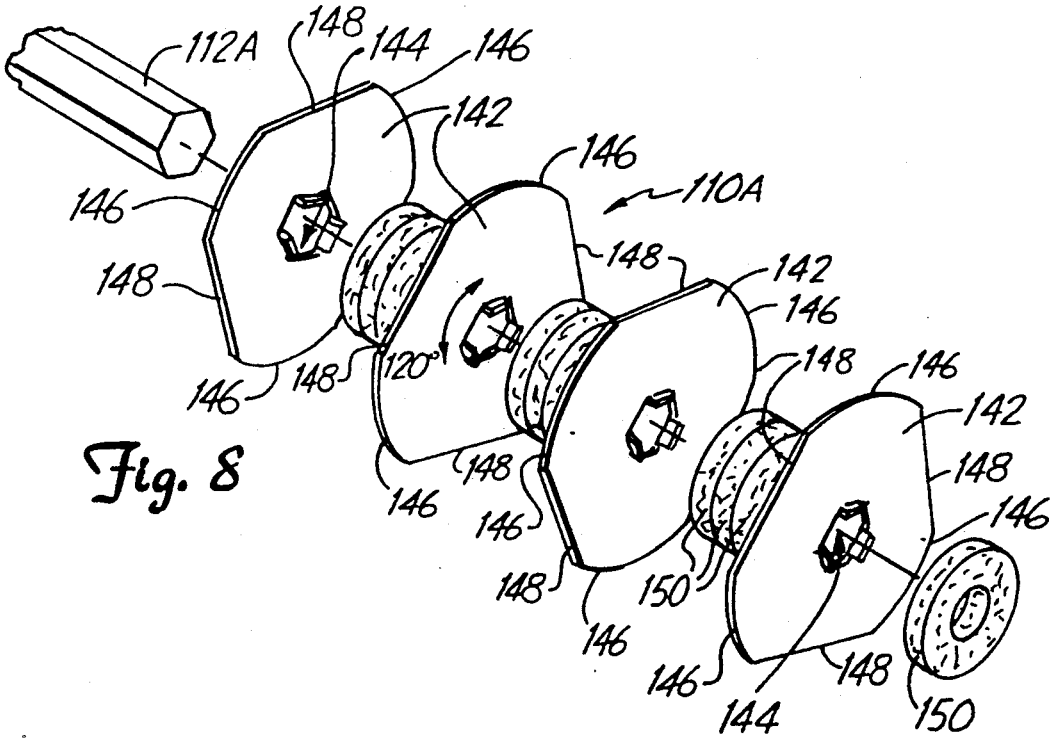
Fig. 8
Fig. 11
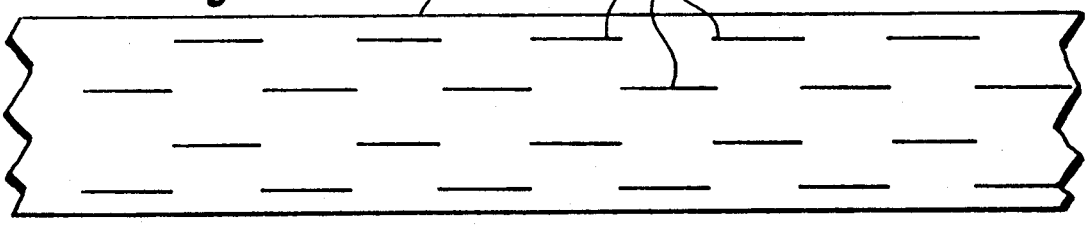
Fig. 12 PRIOR ART
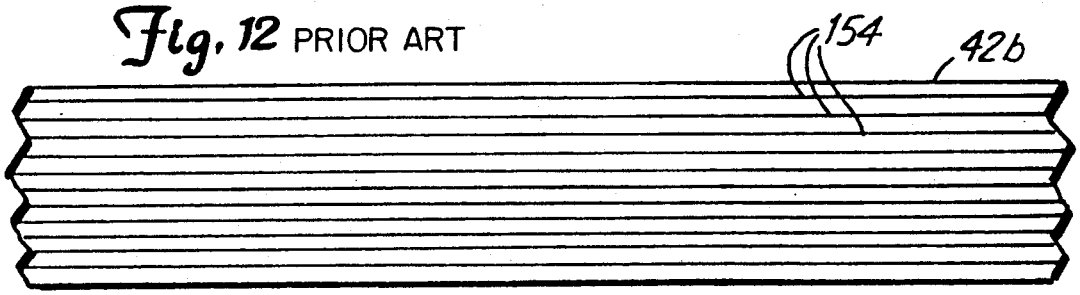

ADHESIVE TAPE DISPENSER

BACKGROUND OF THE INVENTION

The present invention relates generally to the field of dispensers. In particular, the present invention is a definite length tape dispensing apparatus for dispensing thin adhesive tape.

Dispensers for dispensing pressure-sensitive adhesive tape are generally known. One such dispensing apparatus known as an M-82 Definite Length Dispenser is available from the Minnesota, Mining and Manufacturing Company of St. Paul Minn. The M-82 Definite Length Dispenser includes a feed mechanism, a drive assembly for driving the feed mechanism and a stripper mechanism driven by the drive assembly through the feed mechanism. The feed mechanism is defined by a plurality of circular feed discs that are adapted to unwind adhesive tape from a tape roll upon manual actuation of the drive assembly. The stripper mechanism is defined by a plurality of circular stripper discs (the number of stripper discs being equal to the number of feed discs) that are adapted to strip the adhesive tape from the feed discs so that a free end of the adhesive tape can be easily grasped by a user of the Definite Length Dispenser.

The prior art M-82 Definite Length Dispenser is capable of dispensing thick adhesive tape (i.e., adhesive tape having a backing material thickness of greater than 2 mils) or thin adhesive tape (i.e., adhesive tape having a backing material thickness of 2 mils or less). The inherent stiffness of the thick adhesive tape (due to the thickness of its backing material) normally allows the thick tape to come straight off of the stripper discs, such that the free end of the thick tape can be easily grasped by a user of the Definite Length Dispenser. Due to its inherent stiffness, the thick adhesive tape is able to overcome forces that may cause the tape to adhere to the stripper discs. These forces being (1) static present as result of the tape being unwound from the tape roll and (2) adhesive attraction due to the adhesive material on the tape.

Thin adhesive tape, on the other hand, due to the thinner nature of its backing material, does not have the inherent stiffness of thick adhesive tape. Hence, thin adhesive tape, when used with the M-82 Definite Length Dispenser, tends to simply ride with the stripper discs because the combination of (1) static and (2) the adhesive attraction of the adhesive material on the tape is greater than the combating force provided by the minimal inherent stiffness of the thin adhesive tape. Therefore, the thin adhesive tape, when used with the Definite Length Dispenser, typically does not come straight off of the stripper discs (as is the case with the thick adhesive tape) and as such the free end of the thin adhesive tape is not presented such that it can be easily grasped by the user of the Definite Length Dispenser. Typically, thin adhesive tape, when used with the Definite Length Dispenser must be peeled off of the stripper discs, thereby making the prior art M-82 Definite Length Dispenser difficult and frustrating to operate when used with thin adhesive tape.

Furthermore, it is preferable to rotate the stripper discs at a rotational speed faster than the rotational speed of the feed discs to facilitate the stripping of the adhesive tape from the feed discs. In this situation, if the adhesive tape adheres to the stripper discs, the machine will lock up. Thus, with adhesive tapes that tend to stick to the stripper discs, machine operation may be impossible.

There is a continuing need for improved tape dispensers. Specifically, there is a need for a definite length tape dispensing apparatus for dispensing thin adhesive tape such that a free end of the dispensed tape is presented such that it can be easily grasped by a user of the dispensing apparatus.

SUMMARY OF THE INVENTION

The present invention is a tape dispensing apparatus for dispensing pressure-sensitive adhesive tape. The tape dispenser includes a support assembly. A support member is mounted to the support assembly and is adapted to hold a supply of adhesive tape. A feed mechanism is rotatably mounted to the support assembly and includes a plurality of spaced feed discs that are configured to remove a continuous strip of adhesive tape from the supply of adhesive tape. A drive assembly is mounted to the support assembly. The drive assembly includes a manually operated lever arm which is coupled to the feed mechanism through a gear assembly. The drive assembly drives the feed mechanism. A stripper mechanism is mounted to the support assembly adjacent to the feed mechanism. The stripper mechanism includes a plurality of spaced stripper discs, with each stripper disc having a peripheral edge defined by alternating curved and straight edge sections. Adjoining stripper discs are rotated relative to one another such that a curved section of one stripper disc is adjacent to the straight section of an adjacent stripper disc. There are three feed discs for every one stripper disc.

This tape dispensing apparatus is relatively efficient design. By providing the stripper mechanism of the dispensing apparatus with fewer stripper discs, stripper discs with straight and curved edge sections and by rotating adjoining stripper discs such that a curved section of one stripper disc is adjacent to the straight section of an adjacent stripper disc, the amount of surface area of the stripper discs in contact with the adhesive tape is greatly reduced when compared to prior art tape dispensers. This reduction in surface area contact between the stripper discs and the adhesive tape allows the tape dispensing apparatus of the present invention to dispense thin adhesive tape such that a free end of the thin adhesive tape is presented so that it can be easily grasped by a user of the dispensing apparatus. The reduction in surface area contact between the stripper discs and the thin adhesive tape, virtually eliminates the problem of the thin adhesive tape riding with the stripper discs (because of (1) static and (2) the adhesive attraction of the adhesive material on the tape with the stripper discs) associated with prior art definite length dispensers.

BRIEF DESCRIPTION OF THE DRAWINGS

FIG. 8 is an exploded perspective view of a portion of the stripper mechanism shown in FIG. 7.

FIG. 11 is a planar view of a section of a piece of adhesive tape dispensed by the tape dispensing apparatus shown in FIG. 6 in accordance with the present invention.

FIG. 12 is a planar view of a section of a piece of adhesive tape dispensed by the prior art tape dispensing apparatus shown in FIG. 1.

DETAILED DESCRIPTION OF THE PREFERRED EMBODIMENTS

Figure 1:
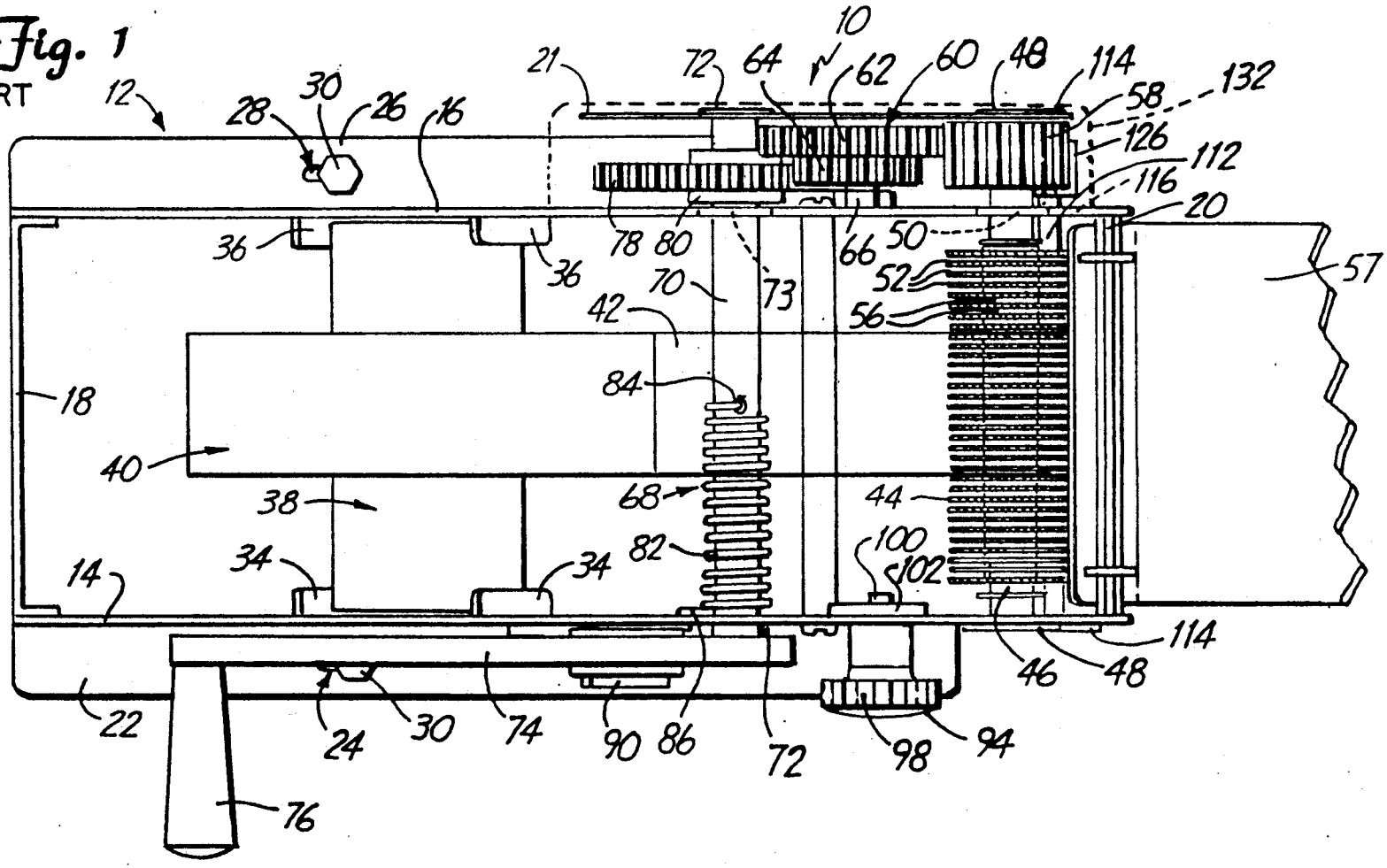
Fig. 1 PRIOR ART
FIG. 1 is a top elevational view of a prior art definite length tape dispensing apparatus with a top cover of the apparatus in an open position.
Figure 2:
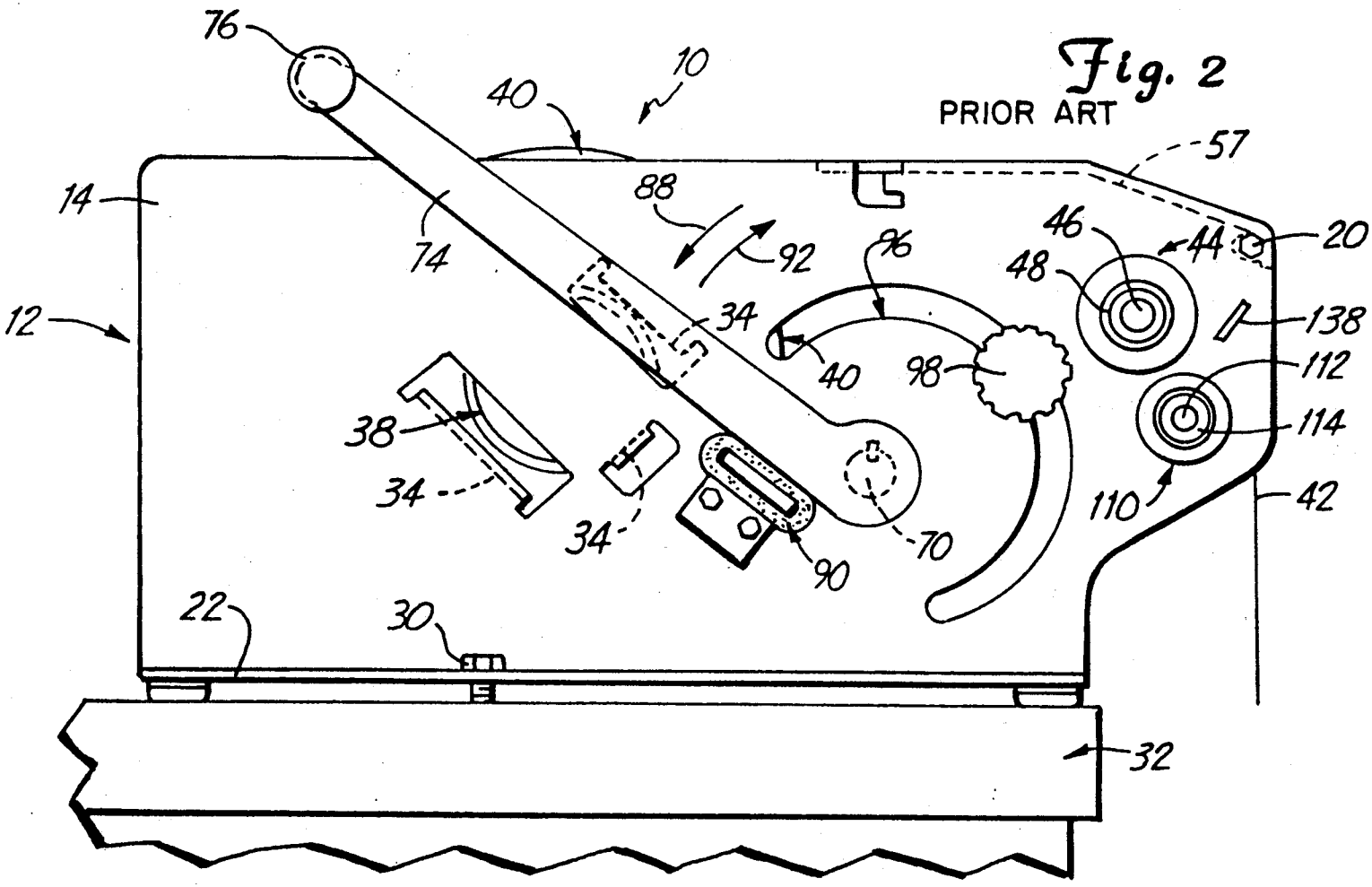
Fig. 2 PRIOR ART
FIG. 2 is a left side elevational view of the prior art tape dispensing apparatus shown in FIG. 1.
Figure 3:
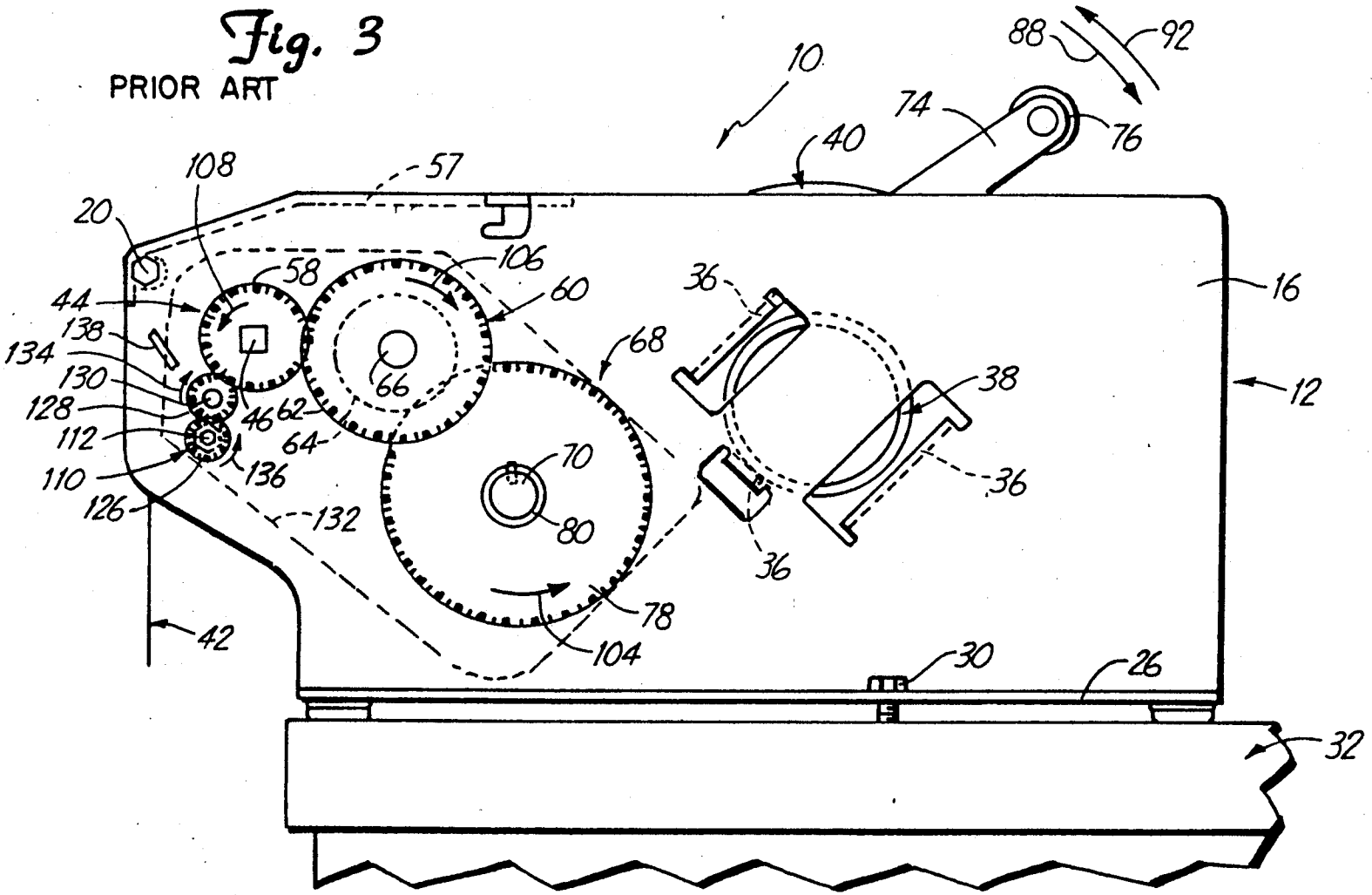
Fig. 3 PRIOR ART
FIG. 3 is a right side elevational view of the prior art tape dispensing apparatus shown in FIG. 1.

FIGS. 1-3 generally illustrate a prior art definite length tape dispensing apparatus 10 (known as an M-82 Definite-Length Dispenser available from Minnesota Mining and Manufacturing Company, St. Paul, Minn.). The illustrated prior art dispensing apparatus 10 includes a support assembly 12 defined by a left side frame member 14 and a right side frame member 16. The left side frame member 14 is secured in a spaced relation relative to the right side frame member 16 by a rear spacer bracket 18, an upper front spacer shaft 20 and a lower front spacer shaft (not shown). The left and right frame members 14 and 16, the rear bracket 18 and the upper spacer shaft 20 and the lower spacer shaft are held together by threaded fasteners (not shown for clarity). As seen in FIG. 1, the right frame member 16 includes a frame plate 21 (removed from FIG. 3 for clarity). The frame plate 21 is secured in a spaced relation relative to the right frame member 16 by a plurality of standoff spacers that have been eliminated from the drawings for clarity. The frame plate 21, the standoff spacers and the right frame member 16 are held together by threaded fasteners (not shown for clarity). The frame plate 21 is discussed further below.

As seen best in FIG. 1, a lower edge of the left frame member 14 includes an outwardly extending mounting flange 22 having a key hole slot 24. Likewise, a lower edge of the right frame member 16 has an outwardly extending flange 26 with a key hole slot 28. The key hole slots 24 and 28 are adapted to receive threaded fasteners 30 that can be used to secure the dispensing apparatus 10 adjacent an edge of a table 32 (see FIGS. 2 and 3).

As seen in FIGS. 1-3, the left and right frame members 14 and 16 include inwardly extending support flanges 34 and 36, respectively. The support flanges 34 and 36 removably receive a tape drum 38 that is adapted to rotatably support a roll 40 of pressure-sensitive adhesive tape 42. To mount a roll 40 of adhesive tape 42 within the prior art dispensing apparatus 10, the drum 38 is first slid out from within the confines of the support flanges 34 and 36. The drum 38 is then inserted through a through opening defined by the tape roll 40, and then the drum 38 is slid back within the confines of the support flanges 34 and 36. The tape roll 40 rotates about the tape drum 38 as adhesive tape 42 is wound off of the tape roll 40.

The adhesive tape 42 is wound off of the tape roll 40 by a rotatable feed mechanism 44. As seen in FIG. 1, the feed mechanism 44 includes a feed shaft 46 which is supported for rotational movement at its opposite ends by ball bushings 48 mounted within through openings in the left frame member 14 and the frame plate 21. The feed shaft 46 extends through a through hole 50 in the right frame member 16 such that the feed shaft 46 can rotate freely relative to the right frame member 16. The feed shaft 46 is substantially square in cross section (see FIG. 3) between the ball bushings 48.

Figure 4:
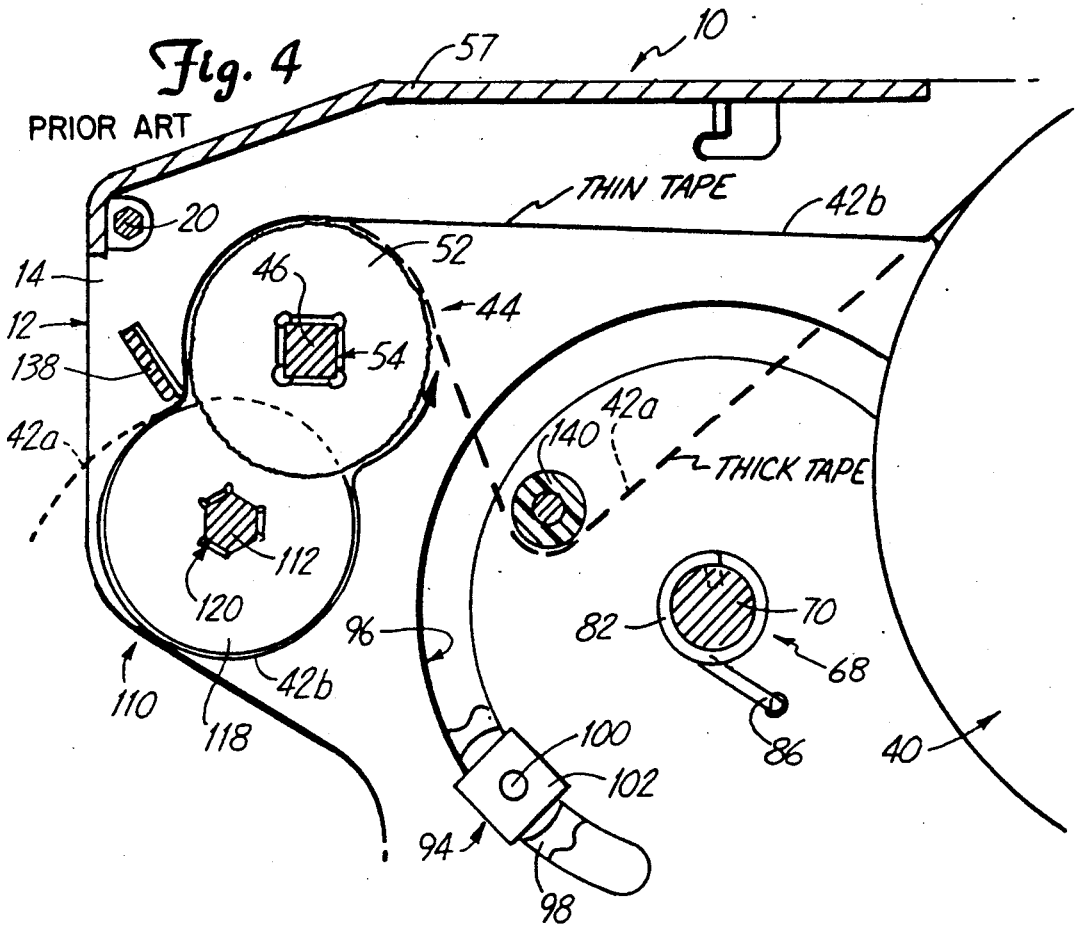
Fig. 4 PRIOR ART
FIG. 4 is an enlarged sectional view showing the particulars of a feed mechanism and a stripper mechanism of the prior art tape dispensing apparatus shown in FIG. 1.

Mounted on the feed shaft 46, between the left and right frame members 14 and 16, are a plurality of spaced, circular feed discs 52. As seen in FIG. 4, each feed disc 52 has a square shaped through hole 54 so that the feed discs 52 are keyed to the feed shaft 46 to rotate therewith. The feed discs 52 are spaced from each other by spacer members 56 interposed between adjacent feed discs 52. The spacer members 56 are integral with the feed discs 52.

As seen in FIG. 1, access to the feed discs 52 of the feed mechanism 44 is available through a pivotable top cover 57 shown in an open position in FIG. 1 and in a closed position in FIGS. 2 and 3. The top cover 57 is hinged to the upper spacer shaft 20. With the tape roll 40 mounted on the drum 38 within the prior art dispensing apparatus 10, one need only wrap a free end of the adhesive tape 42 over the exposed portions of the feed discs 52 (see FIG. 1) to ready the prior art dispensing apparatus 10 for operation. Upon rotation of the feed discs 52 with the feed shaft 46, a continuous strip of the adhesive tape 42 is wound off of the tape roll 40.

As seen in FIGS. 1 and 3, mounted on the feed shaft 46, between the right frame member 16 and the frame plate 21 is a feed gear 58. The feed gear 58 is keyed to the feed shaft 46 such that the feed shaft 46 rotates with the feed gear 58. The feed gear 58 is driven by a dual gear assembly 60 positioned between the right frame member 16 and the frame plate 21. The dual gear assembly 60 includes an outer gear 62 which rotates together with an inner gear 64. The feed gear 58 meshes with the outer gear 62. The dual gear assembly 60 is mounted for rotational movement on an idler shaft 66 secured to the right frame member 16. The dual gear assembly 60 is driven by a manually operated drive assembly 68.

As seen best in FIG. 1, the drive assembly 68 includes a drive shaft 70 which is supported for rotational movement at its opposite ends by ball bushings 72 mounted within through openings in the left frame member 14 and the frame plate 21. The drive shaft 70 extends through a through hole 73 in the right frame member 16 such that the drive shaft 70 can rotate freely relative to the right frame member 16. Fixed to one end of the drive shaft 70 adjacent to the left frame member 14 is a drive lever arm 74 which includes a handle member 76. Mounted on the opposite end of the drive shaft 70 between the right frame member 16 and the frame plate 21 is a drive gear 78 (see FIG. 3). The drive gear 78 is mounted on the drive shaft 70 via a one way clutch bearing 80. The drive gear 78 meshes with the inner gear 64 of the dual gear assembly 60.

As seen in FIG. 1, the drive assembly 68 of the prior art dispensing apparatus 10 further includes a torsion spring 82 that is coiled about the drive shaft 70. A first end 84 of the torsion spring 82 engages the drive shaft 70 and a second end 86 of the torsion spring 82 engages the left frame member 14 (see FIG. 4). The torsion spring 82 is configured to bias the lever arm 74 in a counterclockwise direction as viewed in FIG. 2 and represented by the directional arrow 88. A handle stop member 90 mounted on the left frame member 14 limits the movement of the lever arm 74 in the direction of arrow 88 and defines the at rest position (shown in FIG. 2) of the lever arm 74.

Clockwise movement of the lever arm 74 by manual manipulation (as viewed in FIG. 2 and represented by the directional arrow 92) is limited by a movable stop assembly 94 that rides in an arced shaped slot 96 (see FIG. 2) formed within the left frame member 14. As seen best in FIG. 1, the stop assembly 94 includes a knob member 98 having a threaded portion 100 that threadably engages a clamp member 102 on an opposite side of the left frame member 14. Loosening the knob member 98 allows the stop assembly 94 to be moved within the slot 96. Tightening the knob member 98 maintains the desired position of the stop assembly 94 within the slot 96.

As seen in FIG. 3, movement of the lever arm 74 (upon manual manipulation) in the direction of arrow 92 (i.e. a dispensing stroke of the lever arm 74) rotates the drive gear 78 in the direction of directional arrow 104, which in turn rotates the dual gear assembly 60 in the direction of directional arrow 106, which in turn rotates the feed gear 58 in the direction of directional arrow 108. Rotation of the feed gear 58 rotates the feed shaft 46 and therewith the feed discs 52 which act to unwind the adhesive tape 42 from the tape roll 40 to dispense a length of adhesive tape. To facilitate unwinding of the adhesive tape 42 from the tape roll 40, the peripheral edge of each feed disc 52 is knurled so as to better grip the adhesive tape 42. The position of the stop assembly 94 within the slot 96 defines the extent of the dispensing stroke of the lever arm 74 and thereby the length of the adhesive tape dispensed by the prior art dispensing apparatus 10. The prior art dispensing apparatus 10 is capable of dispensing lengths of adhesive tape from 1½ to 16 inches with one dispensing stroke. Longer lengths may be obtained by repeating the dispensing stroke.

After the dispensing stroke of the lever arm 74, the lever arm 74 is simply allowed to move back in the direction of arrow 88 (i.e. a return stroke of the lever arm 74) back to its at rest position shown in FIG. 2. The return stroke of the lever arm 74 is facilitated by the torsion spring 82. The return stroke of the lever arm 74 does not rotate the drive gear in a direction opposite to the directional arrow 104 due to the presence of the one way clutch bearing 80.

Figure 5:
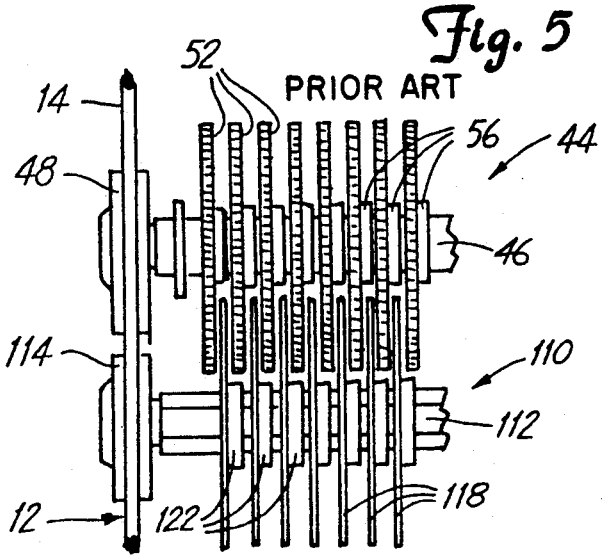
Fig. 5 PRIOR ART
FIG. 5 is a front elevational view showing portions of the prior art feed and stripper mechanisms shown in FIG. 4 with an adhesive tape cut off blade removed.

As seen best in FIGS. 4 and 5, the prior art dispensing apparatus 10 further includes a stripper mechanism 110 mounted to the support assembly 12 adjacent the feed mechanism 44. The stripper mechanism 110 includes a stripper shaft 112 which is supported for rotational movement at its opposite ends by ball bushings 114 mounted within through openings in the left frame member 14 and the frame plate 21. The stripper shaft 112 extends through a through hole 116 in the right frame member 16 such that the stripper shaft 112 can rotate freely relative to the right frame member 16. The stripper shaft 112 is substantially hexagonal in cross section (see FIGS. 3 and 4) between the ball bushings 114.

Mounted on the stripper shaft 112, between the left and right frame members 14 and 16, are a plurality of spaced, circular stripper discs 118. As seen in FIG. 4, each stripper disc 118 has a hexagon shaped through hole 120 so that the stripper discs 118 are keyed to the stripper shaft 112 to rotate therewith. The stripper discs 118 are spaced from each other by spacer elements 122 interposed between adjacent stripper discs 118. The spacer elements 122 are integral with the stripper discs 118. As seen in FIGS. 4 and 5, the stripper discs 118 are arranged such that a portion of a single stripper disc 118 is interposed between adjacent feed discs 52.

As seen best in FIG. 3, mounted on the stripper shaft 112, between the right frame member 16 and the frame plate 21 is a stripper gear 126. The stripper gear 126 is keyed to the stripper shaft 112 such that the stripper shaft 112 rotates with the stripper gear 126. The stripper gear 126, and thereby the stripper discs 118, is driven by a intermediate gear 128 positioned between the right frame member 16 and the frame plate 21. The intermediate gear 128 is in turn driven by the feed gear 58 of the feed mechanism 44. The intermediate gear 128 is mounted for rotational movement on an idler shaft 130 secured to the right frame member 16. As seen best in FIG. 1, the frame plate 21, the drive gear 78, the dual gear assembly 60, the feed gear 58, the intermediate gear 128 and the stripper gear 126 are protected by a side cover 132 secured to the frame plate by a threaded fastener (not shown).

Upon rotation of the feed gear 58, via a dispensing stroke of the lever arm 74, the intermediate gear 128 rotates in the drive gear 78 in the direction of directional arrow 134, which in turn rotates the stripper gear 126 in the direction of directional arrow 136. Rotation of the stripper gear 126 causes rotation the stripper shaft 112 and rotation of the stripper discs 118. The stripper discs 118 act to strip the continuous length of adhesive tape 42 from feed discs 52. The stripper discs 118 preferably rotate at a faster rate of rotation then the feed discs 53 so as to facilitate the stripping of the adhesive tape 42 from the feed discs 52. Preferably, the ratio of the rate of rotation of the stripper discs 118 to the rate of rotation of the feed discs 52 is about 2:1, although other ratios both greater and lower will also work and are contemplated. Moreover, since it is actually the surface speed at the edges of the feed discs 52 and the stripper discs 118 that are to be differentiated from one another, such may just as easily be accomplished by changing the diameter of each of the feed discs 52 from the diameter of each of the stripper discs 118.

With the dispensing of the desired length of adhesive tape 42, the length of adhesive tape 42 is separated by pulling up on the tape to bring the tape across a cut off blade 138 interposed at the intersection of the feed discs 52 and the stripper discs 118. Upon the return stroke of the lever arm 74 the intermediate gear 128 and the stripper gear 126 do not rotate since the drive gear 78 does not rotate due to the one way clutch bearing 80. It is understood that any other motion transfer system can be substituted for the meshed gearing system described above for rotating the respective shafts at any desired rates and for timing the operation thereof, including the use of timing belts, pulleys, sprockets, chains, and the like.

As seen in FIG. 4, in operation, the prior art dispensing apparatus 10 is capable of dispensing thick adhesive tape 42a (i.e., adhesive tape having a backing material thickness of greater than 2 mils) or thin adhesive tape 42b (i.e., adhesive tape having a backing material thickness of 2 mils or less). An example of thin adhesive tape is SCOTCH brand, Thin Film Tape 373 available from Minnesota Mining and Manufacturing Company, St. Paul, Minn. Thick adhesive tape 42a may need to be routed around a wrap roller 140 which extends between the left and right frame members 14 and 16. The wrap roller 140 puts more surface area of the thick adhesive tape 42a into contact with the feed discs 52 so that the feed discs can generate more force to unwind adhesive tape 42a having a low adhesion level or to unwind adhesive tape having a high unwind force requirement. Such high unwind force requirement may result from the specific adhesive or the material and thickness of the tape backing and any treatments made thereto. Typically, the wrap roller 140 is not needed for thin adhesive tape 42b, hence, the thin adhesive tape 42b passes directly to the feed discs 52 from the tape roll 40.

Due to the inherent stiffness of the thick adhesive tape 42a, the thick tape 42a tends to come straight off of the stripper discs 118 as the thick tape 42a passes beneath the cut off blade 138 (see FIG. 4), such that the free end of the thick tape 42a can be easily grasped by a user of the prior art dispensing apparatus 10. Due to the inherent stiffness of the thick tape 42a, the thick tape 42a is able to overcome the forces that may cause the thick tape 42a to adhere to the stripper discs 118. These forces being (1) static present as result of the tape being unwound from the tape roll 40 and (2) adhesive attraction due to the adhesive material on the tape.

Thin adhesive tape 42b, on the other hand, due to the thinner nature of its backing material, does not have the inherent stiffness of the thick tape 42a. Therefore, thin tape 42b, when used with the prior art dispensing apparatus 10, tends to simply ride with the stripper discs 118 (see FIG. 4) because the combination of static and the adhesive attraction of the adhesive material on the tape is greater than the combating force provided by the minimal inherent stiffness of the thin tape 42b. Hence, the thin adhesive tape 42b, when used with the prior art dispensing apparatus 10, typically does not come straight off of the stripper discs 118 (as is the case with the thick adhesive tape 42a) and as such the free end of the thin tape 42b is not presented such that it can be easily grasped by the user of the prior art dispensing apparatus 10. Typically, the thin adhesive tape 42b, when used with the prior art dispensing apparatus 10 must be peeled off of the stripper discs 118. Hence, the prior art dispensing apparatus 10 may be frustrating to operate when used with thin adhesive tape 42b. Moreover, if the stripper discs 118 are rotated at a rate different from the rate of rotation of the feed discs 52, as is preferred to facilitate stripping of the adhesive tape from the feed discs 52, and if the adhesive tape adheres to the stripper discs 118, the stripper discs 118 and the feed discs 52 will lock up.

Figure 6:
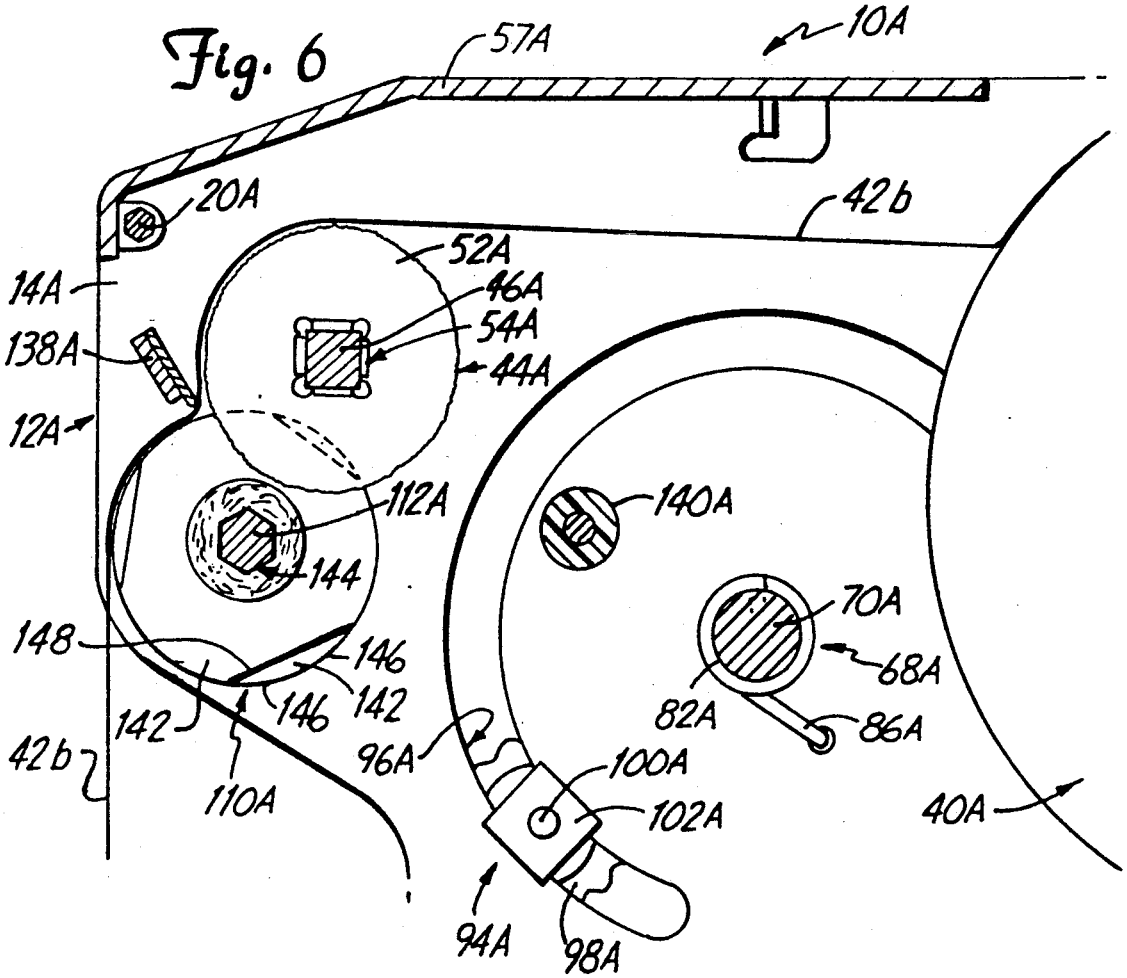
FIG. 6 is an enlarged sectional view showing the particulars of a feed mechanism and a stripper mechanism of a definite length tape dispensing apparatus in accordance with the present invention.
Figure 7:
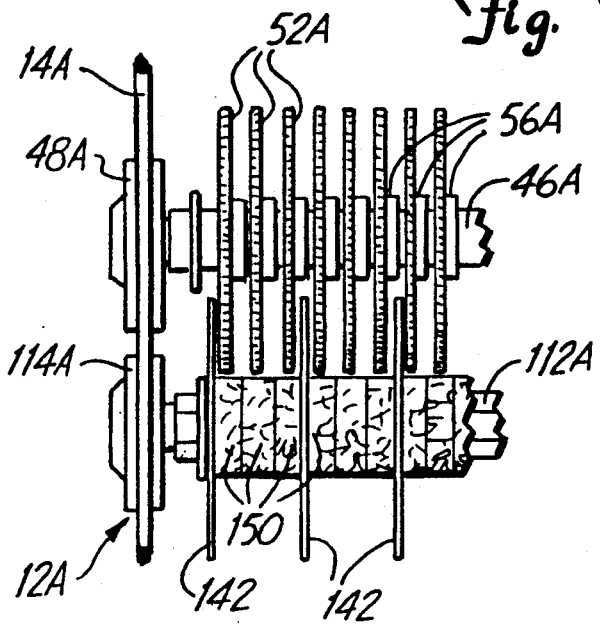
FIG. 7 is a front elevational view showing portions of the feed and stripper mechanisms shown in FIG. 6 with an adhesive tape cut off blade removed.

FIGS. 6–8 generally illustrate an improved stripper mechanism 110A for an improved definite length tape dispensing apparatus 10A for dispensing thin adhesive tape 42b in accordance with the present invention. Like numerals with the designation "A" represent like parts with the prior art dispensing apparatus 10. As in the prior art dispensing apparatus 10, the stripper mechanism 110A of the dispensing apparatus 10A includes a stripper shaft 112A which is supported for rotational movement at its opposite ends by ball bushings 114A mounted within through openings in the left frame member 14A and the frame plate 21A. The stripper shaft 112A is substantially hexagonal in cross section (see FIGS. 6 and 8) between the ball bushings 114A.

Mounted on the stripper shaft 112A, between the left and right frame members 14A and 16A, are a plurality of spaced, stripper discs 142. As seen best in FIG. 8, each stripper disc 142 has a hexagon shaped through hole 144 so that the stripper discs 142 are keyed to the stripper shaft 112A to rotate therewith. As seen best in FIG. 8, each stripper disc 142 has a peripheral edge defined by alternating circumferential edge sections and radially inward edge sections. Preferably, curved edge sections 146 and straight edge sections 148 are provided. Three curved edge sections 146 interposed with three straight edge sections 148 being shown in FIG. 8. The medians of adjacent curved edge sections 146 are disposed at approximately a one hundred and twenty degree angle relative to one another. The medians of adjacent straight edge sections 148 are disposed at a like angle orientation (i.e., 120 degrees) relative to one another. As seen best in FIG. 8, adjacent stripper discs 142 have been rotated sixty degrees relative to one another such that a curved section 146 of one stripper disc 142 is adjacent to a straight section 148 of an adjoining stripper disc 142.

The stripper discs 142 are spaced from each other by a plurality of spacer elements 150 interposed between adjacent stripper discs 142. Three spacer elements 150 being shown between adjoining stripper discs 142 in FIG. 8. As seen best in FIG. 7, there are three feed discs 52A for each stripper disc 142, such that a stripper disc 142 is interposed between every third and fourth feed disc 52A. There are three feed discs 52A for each stripper disc 142.

By providing the stripper mechanism 110A of the dispensing apparatus 10A with fewer stripper discs 142, stripper discs 142 with straight and curved edge sections 148 and 146 and by rotating adjoining stripper discs 142 such that a curved section 146 of one stripper disc 142 is adjacent to the straight section 148 of an adjacent stripper disc 142, the amount of surface area of the stripper discs 142 in contact with the thin adhesive tape 42b is greatly reduced.

Figure 9:
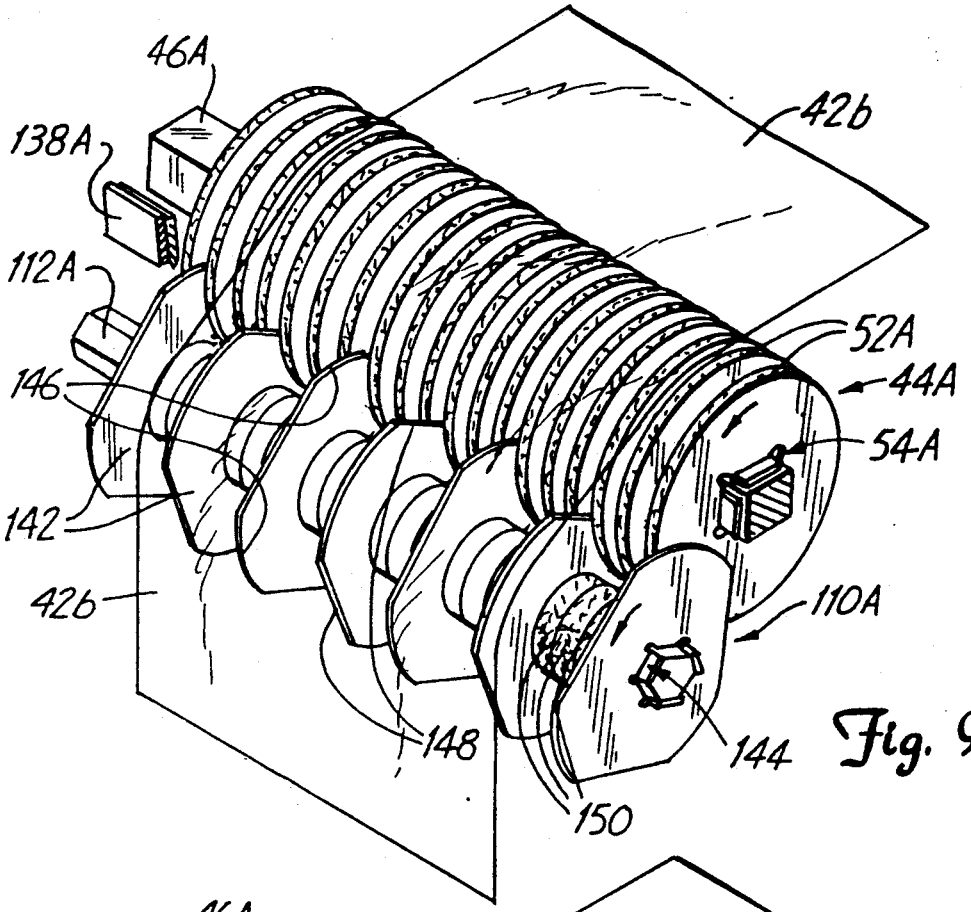
FIG. 9 is a perspective view, with some parts shown in section, of the feed and stripper mechanisms of the tape dispensing apparatus, in accordance with the present invention, dispensing a piece of thin adhesive tape.
Figure 10:
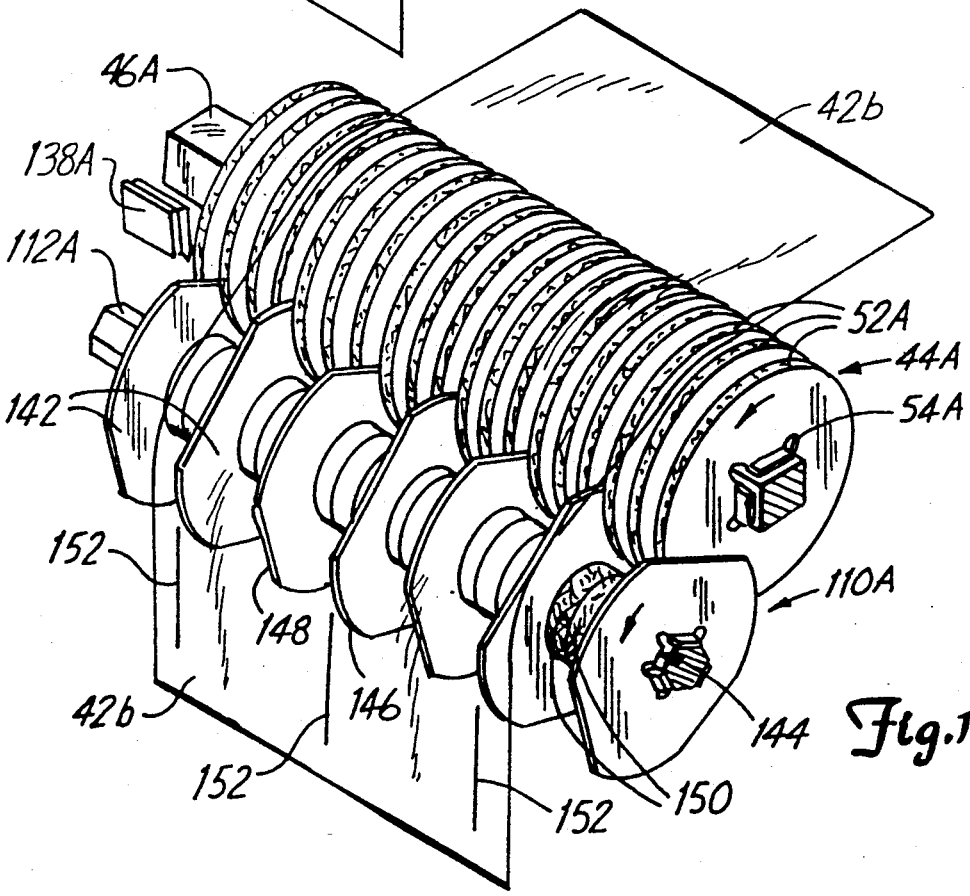
FIG. 10 is a perspective view, with some parts shown in section, similar to FIG. 9 with the stripper mechanism rotated approximately 120 degrees.

FIG. 9 illustrates the stripping of thin adhesive tape 42b from the feed mechanism 44A by the stripper discs 142. Only the curved edge sections 146 of the stripper discs 142 contact the thin adhesive tape 42b. As viewed in FIG. 9, only three (i.e., only those stripper discs 142 whose curved edge sections 146 are immediately adjacent the cut off blade 138A) of the five stripper disks 142 are in contact with the thin adhesive tape 42b. FIG. 10 illustrates the position of the stripper discs 142 after the stripper mechanism 110A has rotated approximately sixty degrees. In this position only two (i.e., those stripper discs 142 that did not contact the thin adhesive tape 42b in FIG. 9) of the five stripper discs 142 are in contact with the thin adhesive tape 42b. The contact of the three stripper discs in FIG. 9 is represented by the lines 152 (see FIG. 10) on the thin adhesive tape 42b. As the stripper mechanism 110A rotates, successive curved edge sections 146 act to release the thin adhesive tape 42b from contact with previous curved edge sections 146 of adjoining stripper discs 142.

This manner of operation of the stripper mechanism 110A of the dispensing apparatus 10A substantially reduces the surface area contact (see lines 152 in FIG. 11) between the stripper discs 142 and the thin adhesive tape 42b, especially when compared to the surface area contact (represented by lines 154 in FIG. 12) of prior art stripper discs 118 with the thin adhesive tape 42b. This reduction in surface area contact allows the tape dispensing apparatus 10A of the present invention to dispense thin adhesive tape 42b such that a free end of the thin adhesive tape 42b is presented so that it can be easily grasped by a user of the dispensing apparatus 10A. The reduction in surface area contact between the stripper discs 142 and the thin adhesive tape 42b, virtually eliminates the problem of the thin adhesive tape riding with the stripper discs 118 (because of (1) static and (2) the adhesive attraction of the adhesive material on the tape with the stripper discs) associated with prior art definite length dispensers 10.

It is further understood that present invention has applicability to many kinds of dispensing devices other than the manual device described above or for dispensing adhesive tape of non-definite lengths as well. Specifically, power driven dispensers or continuous dispensers could be provided with a stripper mechanism and feed mechanism in accordance with the present invention. Moreover, the operation of the stripper mechanism and feed mechanism of the present invention can be modified by changing the angle of a line connecting the shafts of these mechanisms. By changing such angle, the effect of gravity acting on the adhesive tape as it is dispensed will modify the way that the tape is presented to a user.

Although the present invention has been described with reference to preferred embodiments, workers skilled in the art will recognize that changes may be made in form and detail without departing from the spirit and scope of the invention.

What is claimed is:

1. A dispenser for adhesive tape, comprising:

a support assembly;

a support member mounted to the support assembly for holding a supply of adhesive tape;

a feed mechanism mounted to the support assembly for removing adhesive tape from the supply of adhesive tape;

a drive assembly mounted to the support assembly and coupled to the feed mechanism, the drive assembly driving the feed mechanism; and a stripper mechanism mounted to the support assembly adjacent to the feed mechanism, the stripper mechanism including:

a plurality of stripper discs, each stripper disc having a peripheral edge defined by alternating circumferential edge sections and radially inward edge sections that act to strip the adhesive tape from the feed mechanism so that a free end of the adhesive tape can be easily grasped by a user of the tape dispenser, wherein adjoining stripper discs are positioned such that a circumferential section of one stripper disc is adjacent to a radially inward edge section of an adjacent stripper disc.

2. The tape dispenser of claim 1 wherein the drive assembly is coupled to the stripper mechanism for driving the stripper mechanism.

3. The tape dispenser of claim 2 wherein the drive assembly is coupled to the stripper mechanism through the feed mechanism, such that the drive assembly drives the feed mechanism which in turn drive the stripper mechanism.

4. The tape dispenser of claim 1, and further including:

a cut off blade mounted to the support assembly adjacent to the stripper mechanism to allow adhesive tape that is dispensed by the tape dispenser to be separated from the supply of adhesive tape.

5. The tape dispenser of claim 1 wherein the feed mechanism includes a plurality of spaced feed discs, each feed disc having a knurled peripheral edge to facilitate the removal of adhesive tape from the supply of adhesive tape.

6. The tape dispenser of claim 5 wherein there are multiple feed discs for every one stripper disc.

7. The tape dispenser of claim 6 wherein the ratio of feed discs to stripper discs is 3:1.

8. The tape dispenser of claim 1 wherein each stripper has at least two circumferential edge sections and an equal number of radially inward edge sections.

9. The tape dispenser of claim 8 wherein each stripper disc has three circumferential edge sections and three radially inward edge sections, such that one radially inward edge section is interposed between adjoining circumferential edge sections.

10. The tape dispenser of claim 1 wherein the drive assembly includes a movable, drive lever arm which is coupled to the feed mechanism through a gear assembly, such that actuation of the lever arm rotates the feed mechanism relative to the support assembly.

11. The tape dispenser of claim 10 wherein the lever arm is actuated via manual manipulation.

12. The tape dispenser of claim 10, and further including:

a stop assembly movably mounted on the support assembly, the stop assembly being movable relative to the lever arm such that the position of the stop assembly relative to the lever arm determines the length of adhesive tape dispensed by the tape dispenser.

13. A dispenser for dispensing thin tape, comprising:

a support assembly;

a support member mounted to the support assembly for holding a supply of adhesive tape;

a rotatable feed mechanism mounted to the support assembly, the feed mechanism including:

a plurality of circular feed discs for removing adhesive tape from the supply of adhesive tape;

a drive assembly mounted to the support assembly and coupled to the feed mechanism, the drive assembly driving the feed mechanism; and a rotatable stripper mechanism mounted to the support assembly and coupled to the feed mechanism such that stripper mechanism is driven by the drive assembly through the feed mechanism, the stripper mechanism including:

a plurality of stripper discs that operate to strip the adhesive tape from the feed mechanism so that a free end of the adhesive tape can be easily grasped by a user of the tape dispenser, there being multiple feed discs for every one stripper disc, wherein each stripper disc has a peripheral edge defined by alternating circumferential edge sections and radially inward edge sections, and adjoining stripper discs are positioned such that a circumferential section of one stripper disc is adjacent to a radially inward edge section of an adjacent stripper disc.

14. The tape dispenser of claim 13 wherein each stripper disc has three circumferential edge sections and three radially inward edge sections, such that one radially inward edge section is interposed between adjoining circumferential edge sections.

15. The tape dispenser of claim 14 wherein all three circumferential edge sections are substantially identical, and the median of one circumferential edge section is disposed at an angle of approximately 120 degrees relative to the median of an adjoining circumferential edge section.

16. The tape dispenser of claim 13 wherein the ratio of feed discs to stripper discs is 3:1.

* * * * *